United States Patent [19]

Liu

[11] Patent Number: 4,969,297

[45] Date of Patent: Nov. 13, 1990

[54] ROLL-CAMBER GRINDING APPARATUS

[76] Inventor: Daniel Liu, No. 202, I-Shin Rd., Feng-Yuan City, Taichung Hsien, Taiwan

[21] Appl. No.: 415,627

[22] Filed: Oct. 2, 1989

[51] Int. Cl.[5] ..... B24B 49/00

[52] U.S. Cl. ..... 51/165.79; 51/165.89

[58] Field of Search ..... 51/165.79, 165.78, 165.89, 51/33 R, 49, 289 R, 50 PC; 409/92, 107, 121; 82/2 R

[56] References Cited

U.S. PATENT DOCUMENTS 3,552,066 1/1971 Gladstone ..... 51/165.79

4,218,850 8/1980 Sakai et al. ..... 51/165.89

*Primary Examiner*—Frederick R. Schmidt

*Assistant Examiner*—M. Rachuba

*Attorney, Agent, or Firm*—Thomas R. Vigil

[57] ABSTRACT

A roll-camber grinding apparatus includes a base having a pair of linear bearings parallelly fixed to a flat face of the base. A sliding seat is slidably mounted on the linear bearings. A power-driven grinding wheel is mounted on the sliding seat. An adjusting screw rod is transversely and rotatably mounted on the sliding seat. A first roller bearing is threadably connected to the adjusting screw rod so that the first roller bearing is moved transversely when the adjusting screw rod is axially rotated. An elongated swinging link is pivoted on the base near the adjusting screw rod and has two opposed first and second sides. A second roller bearing is mounted to the second side of the swinging link. A cam is rotatably mounted to the base near the second roller bearing. A spring member is provided for urging the first roller bearing to abut against the first side of the swinging rod and the second roller bearing to abut against the cam so that the sliding seat and the grinding wheel on the sliding seat can be moved back and forth with a stroke when the cam is rotated one revolution. A step motor, provided for driving said cam to rotate, has a given rotating speed controlled by a frequency-setting circuit.

1 Claim, 1 Drawing Sheet

ROLL-CAMBER GRINDING APPARATUS

BACKGROUND OF THE INVENTION

This invention relates to a roll-camber grinding apparatus, and more particularly to a roll-camber grinding apparatus having a frequency-setting circuit for precisely controlling the feeding speed of the grinding wheel so as to obtain a desired camber for a roller.

Rollers are widely used in textile, paper-manufacturing and dyeing industries, etc. The rollers are provided with different cambers depending on the requirements of the use thereof. Conventionally, the camber of a specific roller is provided by a grinding apparatus having a grinding wheel which is moved relative to said specific roller to be ground at a given feeding speed. However, an operator must manually adjust said given feeding speed and the stroke of the grinding wheel for grinding a roller with a different camber, thus inconveniencing the operator. In addition, a precise camber cannot be achieved by using said grinding apparatus. To solve these problems, another roll-camber grinding apparatus has been developed. Said roll-camber grinding apparatus is provided with a computer which automatically controls the feeding speed and the stroke of a grinding wheel by means of numerical control so as to precisely achieve a desired camber for a roller. However, such a roll-camber grinding apparatus is complicated in structure and very expensive to manufacture.

SUMMARY OF THE INVENTION

It is therefore a main object of this invention to provide a roll-camber grinding apparatus which is simple in structure and has a low manufacturing cost, as well as a frequency-setting circuit for precisely setting the feeding speed of the grinding wheel and a cam mechanism for adjusting the stroke of the grinding wheel so as to achieve a desired camber for said roller.

Accordingly, a roll-camber grinding apparatus of this invention includes a base having a pair of linear bearings parallelly fixed to a flat face thereof. A seat is slidably mounted on the linear bearings is moved in a first direction parallel thereto. A power-driven grinding wheel is mounted on the sliding seat. An adjusting screw rod is rotatably mounted on the sliding seat in a second direction generally perpendicular to the first direction. A first roller bearing is threadably connected to the adjusting screw rod so that the first roller bearing is moved in the second direction when the adjusting screw rod is axially rotated. An elongated swinging link is pivoted to the flat face of the base at a pivot end thereof near the adjusting screw rod. The swinging link has a first side adjacent the first roller bearing and a second side opposed to the first side of the swinging link. A second roller bearing is mounted to a middle section of the second side thereof. A cam is rotatably mounted to the flat face of the base near the second roller bearing. A spring member is connected between the sliding seat and the flat face of the base, urging the first roller bearing to abut against the first side of the swinging rod, and urging the second roller bearing to abut with the cam so that said sliding seat and the grinding wheel on said sliding seat can be moved back and forth with a stroke in the first direction when the cam is rotated one revolution. A step motor is mounted to the flat face of the base for driving said cam to rotate. The step motor has a given rotating speed so that the grinding wheel can be moved back and forth at a predetermined feeding speed.

A frequency-setting circuit is provided on the base for setting a frequency which controls said given rotating speed of the step motor. Thereby, the feeding speed of the grinding wheel for grinding a roller can be precisely controlled by the frequency set by the frequency-setting circuit, and the stroke of the grinding wheel can be adjusted by moving the first roller bearing relative to said pivot end of the swinging link.

BRIEF DESCRIPTION OF THE DRAWINGS

Other features and advantages of this invention will become apparent in the following detailed description of the preferred embodiments of this invention with reference to the accompanying drawings, in which.

DETAILED DESCRIPTION OF THE PREFERRED EMBODIMENTS

Figure 1:
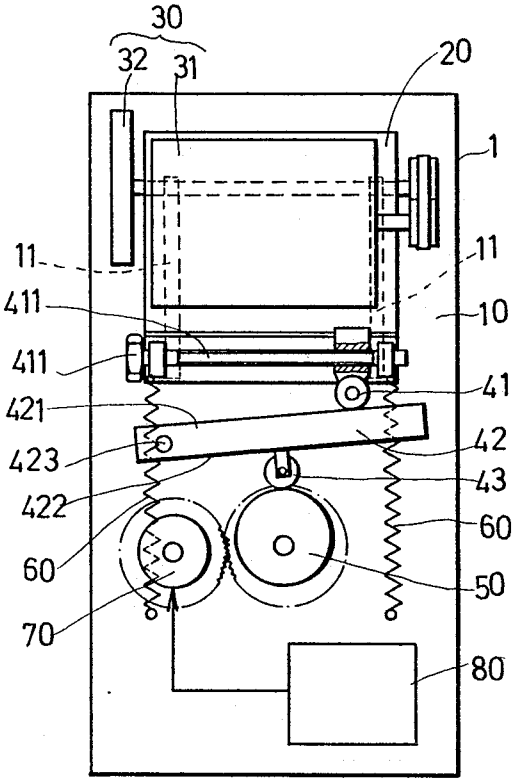
FIG. 1 is a schematic plan view of a first preferred embodiment of a roll-camber grinding apparatus of this invention.

Referring to FIG. 1, a schematic plan view of a preferred embodiment of a roll-camber grinding apparatus of this invention includes a base 1 having a pair of linear bearings 11 parallelly fixed to a flat face 10 thereof. A sliding seat 20 is slidably mounted on the linear bearings 11 and moved in a first direction parallel thereto. A grinding device 30 is mounted on the sliding seat 20. The grinding device 30 includes a motor 31 and a grinding wheel 32 driven by said motor 31. An adjusting screw rod 411 is rotatably mounted on the sliding seat 20 in a second direction generally perpendicular to said first direction. A first roller bearing 41 is threadably connected to the adjusting screw rod 411 at the right side of the sliding seat 20 so that the first roller bearing 41 is moved in said second direction when the adjusting screw rod 41 is axially rotated.

An elongated swinging link 42 is pivoted on the flat face 10 of the base 1 at a pivot end 423 thereof near the adjusting screw rod 41. The swinging link 42 has a first side 421 adjacent the first roller bearing 41 and a second side 422 opposed to the first side 421 of the swinging link 42. A second roller bearing 43 is mounted to a middle section of the second side 422 thereof. A cam 50 is rotatably mounted to the flat face 10 of the base 1 near the second roller bearing 43. Two coiled springs 60 are parallelly connected between the sliding seat 20 and the flat face 10 of the base 1, urging the first roller bearing 41 to abut against the first side 421 of the swinging rod 42 and the second roller bearing 43 to abut with the cam 50 so that the sliding seat 20 can be moved back and forth with a stroke in the first direction when the cam 50 is rotated one revolution. A step motor 70 is mounted to the flat face 10 of the base 1 for driving the cam 50 to rotate. The step motor 70 has a given rotating speed so that the grinding wheel 32 can be moved back and forth at a predetermined feeding speed. A frequency-setting circuit 80 is provided on the base 1 for setting a frequency which controls said given rotating speed of the step motor 80. Thereby, the feeding speed of the grinding wheel 32 for grinding a roller (not shown) can be precisely controlled by the frequency set by the frequency-setting circuit 80 and the stroke of the grinding wheel 32 can be adjusted by axially rotating the adjusting rod 411 to move the first roller bearing 41 relative to said pivot end 423 of the swinging rod 42 in a manner as described hereinbefore. In this way, a desired roll-camber of a roller can be obtained by previously setting the stroke and the feeding speed of the grinding wheel 32 which can be easily accomplished by resetting the frequency applied to the step motor 70 and changing the relative positions of the first roller 41 and the pivot end 423 of the swinging link 42 in a manner which will described hereinafter.

Figure 2:
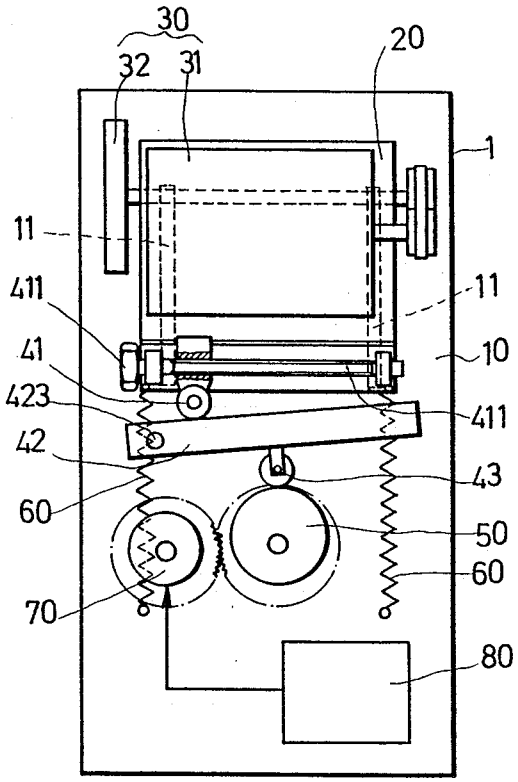
FIG. 2 is a schematic plan view showing a second preferred embodiment of a roll-camber grinding apparatus of this invention.

Referring to FIG. 2, the first roller bearing 41 is moved to the left side of the sliding seat 20 so that the relative distance of the first roller bearing 41 from the pivot end 423 of the swinging link 42 is smaller than that of the first roller bearing 41 from the pivot end 423 of the swinging link 42 of the embodiment shown in FIG. 1. Therefore, the stroke of the grinding wheel 32 in FIG. 2 is smaller than that of the grinding wheel 32 in FIG. 1.

With this invention thus explained, it is apparent that numerous modifications and variations can be made without departing from the scope and spirit of this invention. It is therefore intended that this invention be limited only as indicated in the appended claims.

I claim:

1. A roll-camber grinding apparatus comprising:

a base having a flat face to which a pair of linear bearings is parallelly fixed;

a sliding seat slidably mounted on said linear bearings which is moved in a first direction parallel thereto, said sliding seat having a motor and a grinding wheel driven by said motor mounted thereon;

an adjusting screw rod rotatably mounted on said sliding seat in a second direction generally perpendicular to said first direction, said adjusting screw rod having a first roller bearing threadably connected thereto which is moved in said second direction when said adjusting screw rod is axially rotated;

an elongated swinging link having a pivot end connected to said flat face of said base near said adjusting screw rod, and a first side and a second side which is opposite to said first side, said second side of said swinging link having a second roller bearing mounted to a middle section thereof;

a cam rotatably mounted to said flat face of said base near said second roller bearing;

a spring member connected between said sliding seat and said flat face of said base, urging said first roller bearing to abut against said first side of said swinging rod and said second roller bearing to abut against said cam so that said sliding seat and the grinding wheel thereon can be moved back and forth with a stroke in said first direction when said cam is rotated one revolution;

a step motor mounted to said flat face of said base for driving said cam to rotate, said step motor having a given rotating speed so that said grinding wheel can be moved back and forth at a predetermined feeding speed; and a frequency-setting circuit for setting a frequency so as to control said given rotating speed of said step motor;

whereby said feeding speed of said grinding wheel for grinding a roller can be controlled by said frequency set by said frequency-setting circuit and said stroke of said grinding wheel can be adjusted by moving said first roller bearing relative to said pivot end of said swinging link.

* * * * *